US007225470B1

(12) United States Patent
Bradford

(10) Patent No.: US 7,225,470 B1
(45) Date of Patent: Jun. 5, 2007

(54) PROTECTIVE BOOTS AND PANT COMBINATION

(75) Inventor: Kelly Bradford, Decatur, AL (US)

(73) Assignee: Lakeland Industries Inc, Ronkonkoma, NY (US)

( * ) Notice: Subject to any disclaimer, the term of this patent is extended or adjusted under 35 U.S.C. 154(b) by 0 days.

(21) Appl. No.: 10/737,620

(22) Filed: Dec. 15, 2003

(51) Int. Cl.
*B64G 6/00* (2006.01)

(52) U.S. Cl. ..... 2/2.11

(58) Field of Classification Search ..... 2/2.11, 2/456, 242, 270, 232, 69, 79, 227, 69.5, 2.14, 2/2.15, 22, 911, 919, 81, 82; 36/1.5, 2 R
See application file for complete search history.

(56) References Cited

U.S. PATENT DOCUMENTS 4,864,742 A * 9/1989 Grilliot et al. ..... 36/109
5,068,919 A * 12/1991 MacKendrick et al. ..... 2/2.12
6,141,802 A * 11/2000 Drake ..... 2/227
6,374,414 B1 * 4/2002 Collier ..... 2/69
6,748,609 B1 * 6/2004 Garigan ..... 2/457

* cited by examiner

*Primary Examiner*—Tejash Patel
(74) *Attorney, Agent, or Firm*—John Lezdey

(57) ABSTRACT

A protective garment consisting of boots and pants which can be quickly attached and detached. The boots contain an attachment ring which sealingly mates with a respective attachment ring on the pant leg by a bayonet attachment. There is also provided a kit for retrofitting existing boots and protective garments.

13 Claims, 3 Drawing Sheets

PROTECTIVE BOOTS AND PANT COMBINATION

FIELD OF THE INVENTION

The present invention relates to the combination of safety boots and pants which are used by sportsmen, military, firemen, and the like that provide protection from the environment. More particularly, there is provided a quick release of protection boots from a protective garment, especially pants.

BACKGROUND OF THE INVENTION

Protective pants and boots are used by fishermen who wade into water in order to fish. Generally, the boot portion of the protective garment is an integral part of the pants portion. In order to remove the boots, the whole garment must be removed.

The military in a dangerous environment such as hazardous gas generally don a protective garment to cover the boots and the person. This creates a problem that the foot portion of the garment would be abraded so as to provide a leak into the garment. It would be preferable to have protective boots which can be quickly attached and detached from a protective garment since the hazardous environment usually occurs unexpectedly.

Firemen generally wear protective boots and wear protective garments in an atmosphere which is generally expected because of a previous warning. In such cases it is preferred to be able to quickly attach a protective garment to protective boots and to easily detach them for easy and quick removal so as to decontaminate the items if required.

SUMMARY OF THE INVENTION

The present invention provides a means for modifying existing boots and protective garments to provide the combination of protective boots which can be quickly attached to or released from a protective garment. More particularly, there is provided an attachment for a protective boots and an attachment to the pants or pants portion of a protective garment which creates a seal against liquids and gases. Accordingly, there is provided an attachment to the pants by a ring which bayonets into a sealed position with a mating ring attached on the top of the boot.

The kind of attachment of the rings to the pants and the boots can be made depending on the activity of the user.

Advantageously, a locking mechanism is utilized to prevent any accidental detachment of the units.

It is therefore a general object of the invention to provide a means for connection and disconnection of protective boots from a protective garment.

It is another object of the invention to provide a means for modifying existing boots and protective pants so as to provide a quick release mechanism.

It is a further object of the invention to provide an attachment and detachment means for boots and protective garments which will survive rough and strenuous activity without forming a leak.

These and other objects and advantages will become more apparent from a reading of the preferred embodiments and from the drawings.

The term "bayonet" as used herein refers to an attachment between two parts in which one part has tabs and the other part has an L-shaped slot which mates the parts together.

DESCRIPTION OF THE PREFERRED EMBODIMENTS

Figure 1:
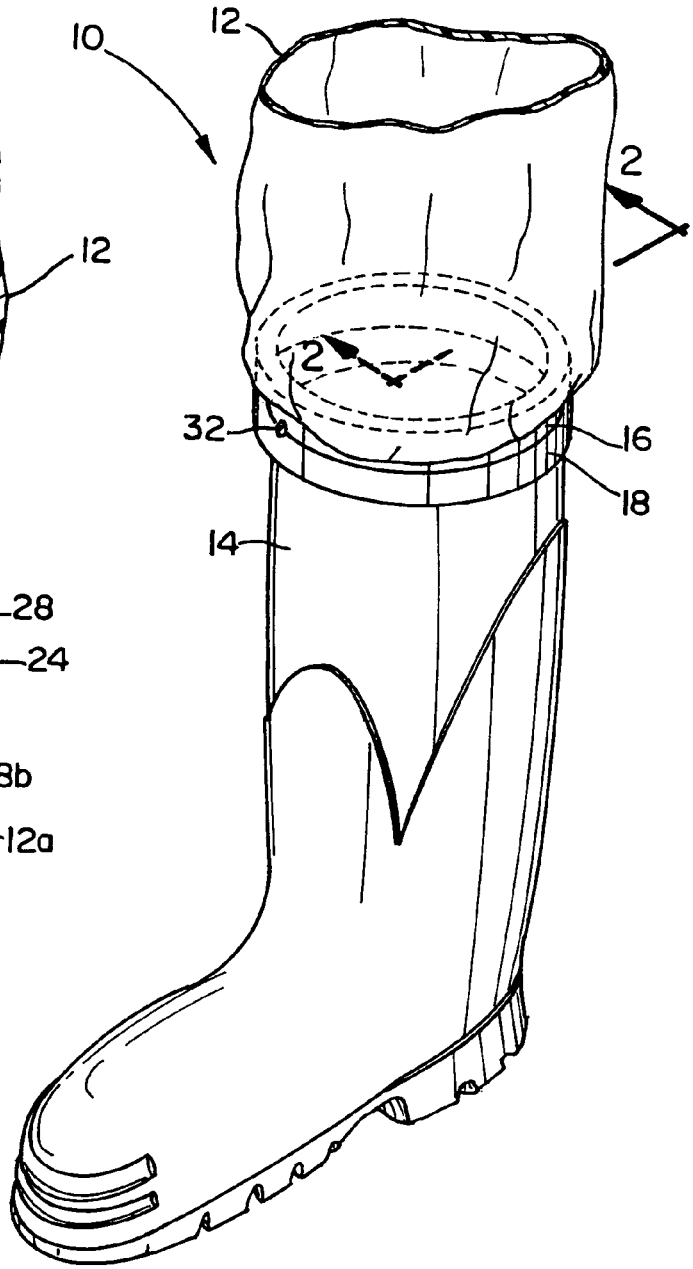
FIG. 1 is a perspective view showing the attachment of a pant leg to a boot according to one embodiment of the invention.

As shown in FIG. 1 a pant cuff and boot assembly 10 is shown in its simplest form. A sealing ring 16 is attached to the cuff of the pant leg 12 of a protective garment. A mating sealing ring 18 is attached outside and at the top of a protective boot 14. One of the rings 16, 18 is provided with a bayonet slot (not shown) so that a twist of a ring seals the parts 16, 18 together. A locking means 32 is provided which prevents unsealing of the rings 16, 18. The locking means can comprise a screw that locks into a mating portion of a ring in a way which can prevent entry of any liquids or gas. Alternatively, the locking means 32 can be in the form of a sealed plug.

The groove in one of the rings preferably contains an O-ring to provide an effective seal against gas. The rings 16, 18 can be attached to their respective parts by means depending upon whether they comprise metal or synthetic materials. The simplest form is to adhere the rings 16, 18 to their respective parts with an adhesive. Preferable the adhesive is a high strength epoxy adhesive or the parts are sonic bonded.

The simplest arrangement is most suitable for low risk use such as for waders for fishermen or for rainwear where the strenuous activity is minimal. This type of arrangement is suitable for installation at the time of manufacture.

Figure 2:
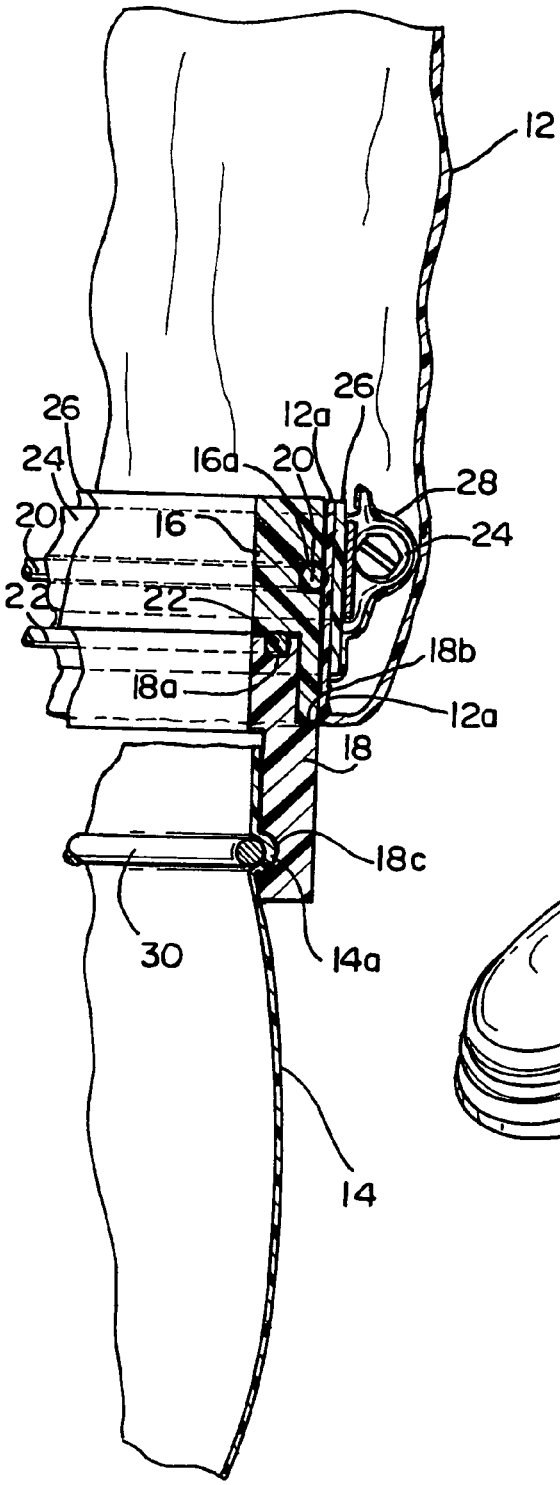
FIG. 2 is a sectional view taken along line 2—2 of FIG. 1 showing another embodiment of the invention.
Figure 3:
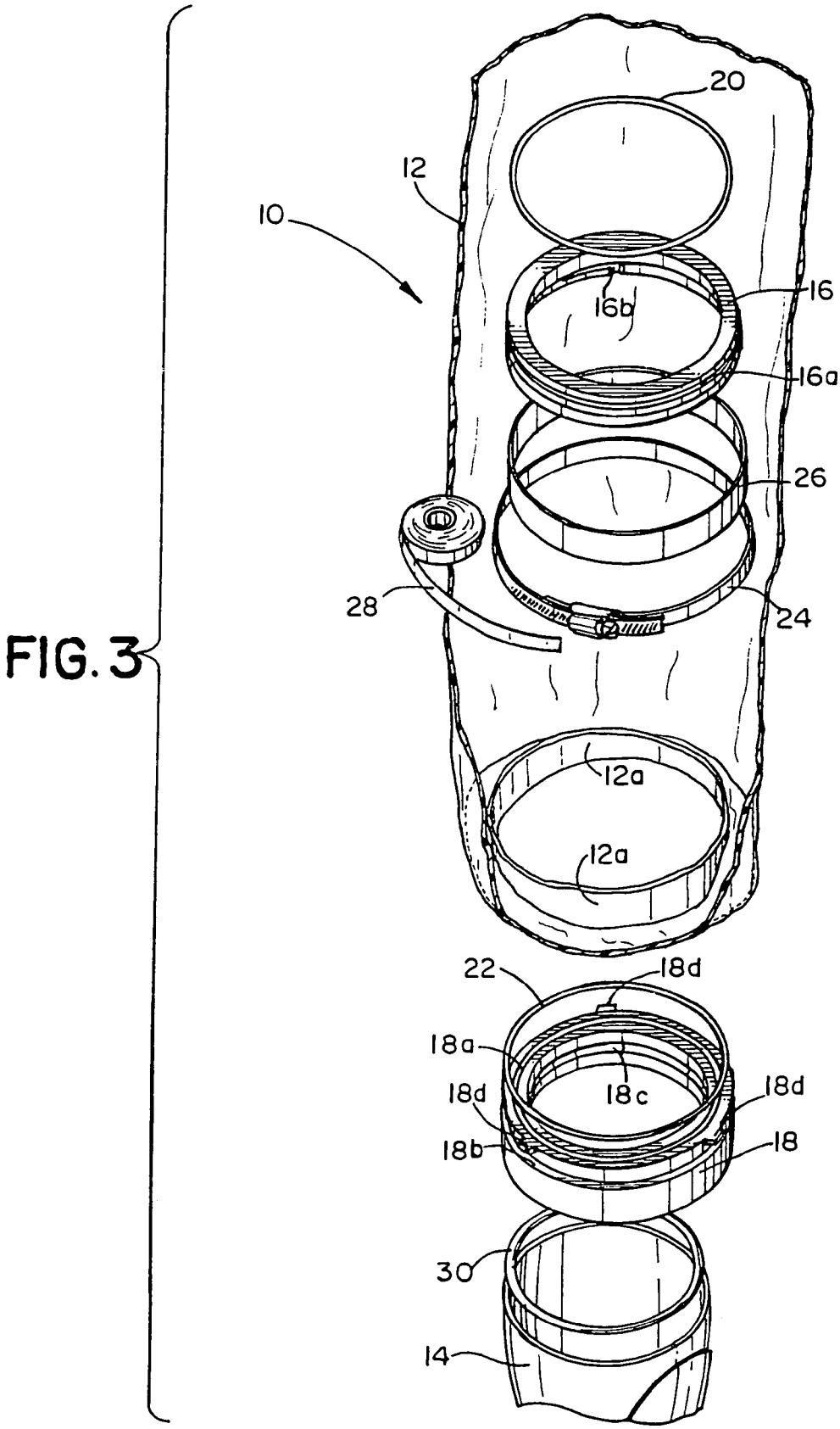
FIG. 3 is an exploded view of a cuff and boot assembly according to a further embodiment of the invention.

FIGS. 2 and 3 illustrate a further embodiment of the invention wherein rings 16 and 18 are part of an assembly to retrofit an existing pant leg 12 of a protective garment to a boot 14 for use in a hazardous environment. The boot ring 18 is adhered at the top and outside of boot 14 by adhesive. A metal retaining ring 30 can be placed within the inside of boot 14 to hold the boot within groove 18*c* using 18. Ring 18 is provided with tabs 18*d* for mating with the bayonet lock slots 16*b* of the upper ring 14. Ring 18 contains grooves 18*a* on the top and mates with ring 16 which contains an O-ring 22 as a static seal. At the top of ring 18 is stop 18*d* which aids in correctly aligning rings 16 and 18. Stop 18*d* also aligns locking tab 18*d* of the bayonet tab 18*d*.

Ring 16 which holds pant leg 12 by a cuff 12*a* which is retained in place by clamp 24. Ring 16 contains bayonet locking slots 16*b* which mates and cooperates with bayonet tabs 18'*d* of ring 18 and is locked in place by locking screw 32. Ring 16 has a groove 16*a* with an O-ring 20 to provide a seal with the clamp ring 24. A rubber or plastic band 26 may be optionally placed under clamp ring 24 to prevent accidental tearing of the cuff. Clamp ring 24 has a mechanical locking mechanism which optionally may be covered by a protective band such as tape 28.

It should be understood that the optional materials are used as added precautions and depend on the type of clamp and locking mechanisms utilized. The principal features comprise the ring 14 which retains the pant leg and provides a locking fit by a bayonet arrangement with the boot ring 18.

Figure 4:
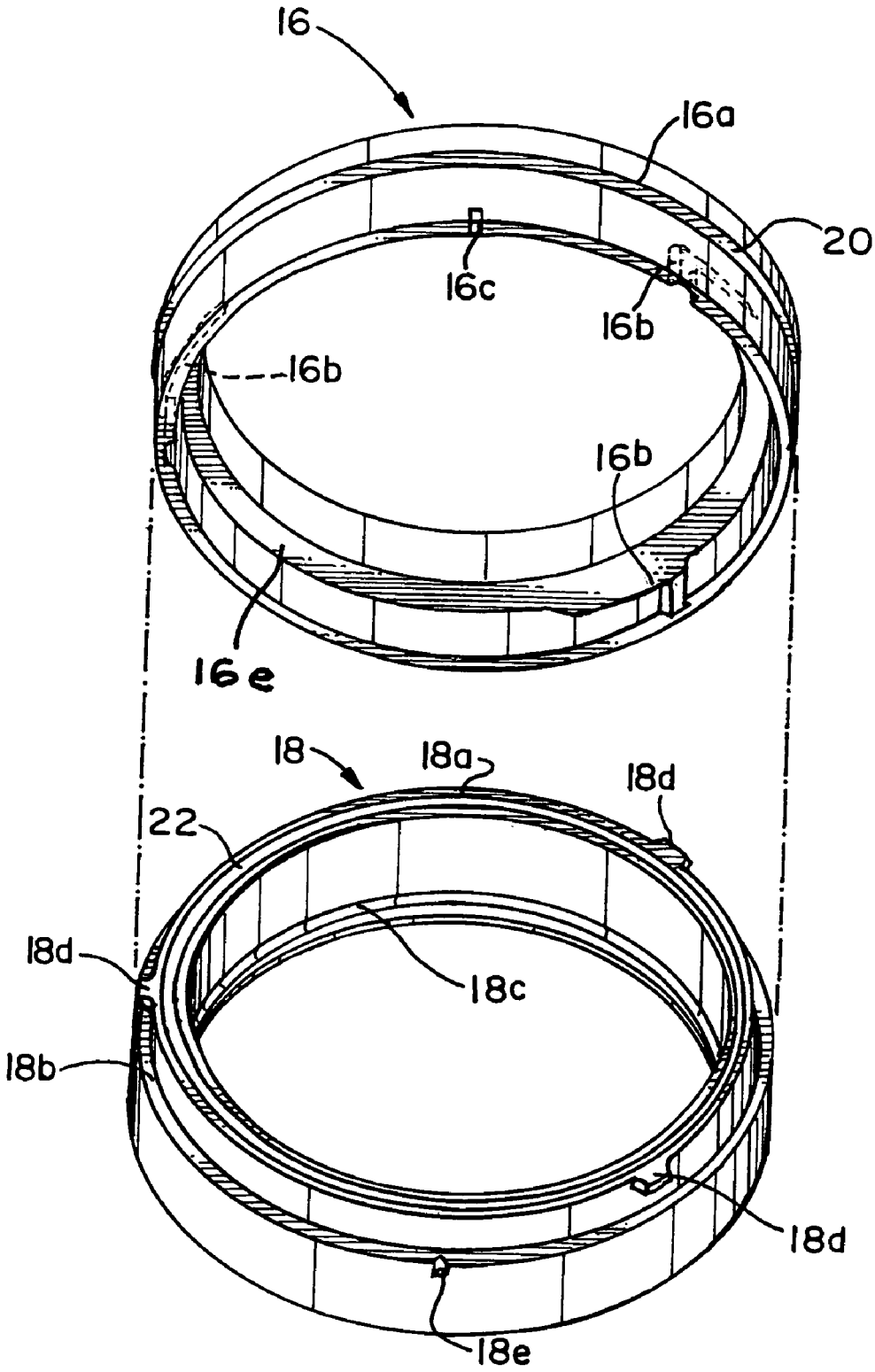
FIG. 4 is an exploded view showing the sealing arrangement of the sealing rings of FIG. 1.

FIG. 4 illustrates in greater detail the sealing and locking arrangement of the present invention. Ring 18 seals against ledge or face 16*e* of ring 16 by way of face or edge 18*b* O-ring 22 creates the seal on ledge 16*e*. 16*c* is the locking groove for the boot ring 18. The two grooves hold locking screw 32 locking slots. 16*b* of the ring 16 and tabs 18*d* of ring 18 provide the bayonet arrangements provide the twist locking and stopping for the proper alignment of the rings 16, 18 so that they can be locking in place with locking screw 32.

As shown in FIG. 4 the locking arrangement between the pant legs and the boots can simply be made by attachment to the boot and cuffs by use of adhesives and compression fitting. However, when extreme concern is involved because of a hazardous environment then the additional precautions are required to prevent any leakage of hazardous fluids or gases. In which case, additional seals can be provided.

To attach ring 16 to the pant leg 12, a cuff 12*a* is prepared and placed over the outside of ring 16. An O-ring 20 is then placed over the cuff 12*a* and presses into groove 16*a*. Adhesive can also be used to adhere the cuff 12*a* to the ring 16. A clamp 24 is then tightened over the cuff 12*a* and ring 16 to hold the pant leg securely to the ring 16. Between the clamp 24 and the cuff 12*a* a protective covering can be used such as a rubber or elastic band 26 to prevent the clamp 24 from inadvertently tearing the pant leg 12. A tape 28 may be used to cover the clamp 24.

The rings 16, 18 may be provided with one or more tabs and one or more L-shaped slots which received the tabs to connect the two rings, preferably at least two tabs and cooperating slots are used to form a seal which can be locked in place.

The term "protective garment" includes pants, coveralls, and the like which are conventional plastic materials used by the military and firemen in hazardous atmospheres.

It is understood that the rings and accessories can be provided in a kit so that individuals can retrofit existing protective garments and boots.

While particular embodiments of the present invention has been illustrated and described, it will be obvious to those skilled in the art that various changes and modifications can be made without departing from the spirit and scope of the invention, and it is intended to cover the appended claims all such modifications that are within the scope of this invention.

What is claimed is:

1. In a protective garment comprising boots and pants portions, with pant legs, the improvement which comprises a first means comprising a ring containing an inner groove in which an O-ring holds said boot and is attached at the top and outside of each of said boots and a second means comprising a ring at the bottom of each pant leg, one of said means comprises at least one L-shaped slot for receiving said at least one tab whereby said first and second means are sealed together to prevent entry of fluids and unsealed by a twisting movement, and locking means to prevent unsealing.

2. The protective garment of claim 1 wherein the pants contain cuffs in which each cuff is adhered to the outside of a ring of said second means and also held by an O-ring.

3. The protective garment of claim 2 including clamps for holding said cuffs against said rings of said second means.

4. The protective garment of claim 1 wherein each ring is plastic.

5. The protective garment of claim 1 wherein said locking means comprise a screw which prevents movement of said first and second means when sealed together.

6. The protective garment of claim 1 wherein said first means comprises a pair of rings which are adhesively attached to the top of said boots, said rings each having an outer ledge and a groove on their top carrying an O-ring, and said second means comprises a pair of rings which can sit on said ledge and comprises and internal ledge which sits on said O-ring and whereby the boot rings and pant rings can be twisted into a sealed relationship.

7. The protective garment of claim 6 including tabs and L-shaped slots for placing said rings in a sealed relationship.

8. The protective garment of claim 7 including locking means to prevent movement of said rings after sealing.

9. A kit for providing a quick release and attachment of a protective garment to protective boots which comprises a first pair of rings for attachment to the top and outside of said boots and a second pair of rings for attachment to the legs of a protective garment, one pair of rings having at least one tab and the other pair of rings having an L-shaped slot for receiving said at least one tab to provide a seal between the rings when twisted, and means for locking said rings, one of said first and second pair of rings contains an inner groove in which an O-ring holds said boot.

10. The kit of claim 9 including an adhesive.

11. The kit of claim 9 wherein one pair of rings comprises an outer ledge and the other pair of rings can sit on said outer ledge to provide a seal and has an internal ledge which sits on top of a ring to provide a further seal.

12. The kit of claim 9 including clamping means for holding a pant leg on a ring.

13. The kit of claim 9 including means for holding a ring on the top of a boot.

* * * * *